United States Patent [19]

Carney, Jr. et al.

[11] 4,441,431

[45] Apr. 10, 1984

[54] RAILWAY HATCH COVER AND STRAP SAFETY TAB LATCHING ASSEMBLY

[75] Inventors: John L. Carney, Jr., St. Louis; Richard L. Gilbert, Foley, both of Mo.

[73] Assignee: ACF Industries, Incorporated, New York, N.Y.

[21] Appl. No.: 286,234

[22] Filed: Jul. 23, 1981

[51] Int. Cl.[3] ..... B61D 17/12; B61D 39/00; B65D 45/08

[52] U.S. Cl. ..... 105/377; 105/308 E; 114/203; 220/314

[58] Field of Search ..... 105/377, 308 E; 220/316, 324, 314, 323, 322; 114/203

[56] References Cited

U.S. PATENT DOCUMENTS 1,158,946 11/1915 McGray ..... 114/203
4,248,160 2/1981 Carney, Jr. et al. ..... 105/377

FOREIGN PATENT DOCUMENTS 339919 1/1904 France ..... 220/324

*Primary Examiner*—Robert B. Reeves
*Assistant Examiner*—Howard Beltran
*Attorney, Agent, or Firm*—Henry W. Cummings; J. Joseph Muller

[57] ABSTRACT

A pivoting hatch cover and strap assembly has an overcenter latch assembly which is pivotably mounted upon the car roof at a location opposite the common hatch cover and strap pivot axis. This latch assembly includes a bifurcated overcenter locking handle which has a pair of cam surfaces which in closed position engage spaced wear plate surfaces located on the strap. A tab is located on the wear plate adjacent to but outboard of the cam surface on the operating handle. The tab makes a sufficient angle with the horizontal and extends upwardly and outwardly from the cam surface a distance sufficient to prevent the cam portion of the operating handle from moving longitudinally, and disengaging from the strap until pressure within the car is dissipated and thus prevents the strap and cover flying open.

6 Claims, 6 Drawing Figures

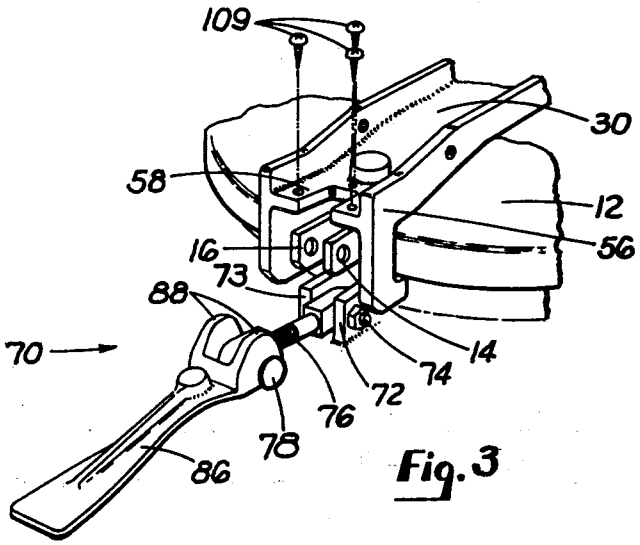
Fig. 3
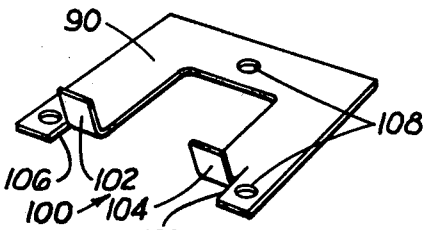
Fig. 5
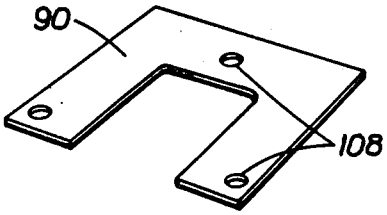
Prior Art Fig. 4
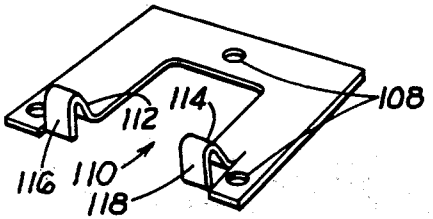
Fig. 6

RAILWAY HATCH COVER AND STRAP SAFETY TAB LATCHING ASSEMBLY

BACKGROUND OF THE INVENTION

In U.S. Pat. No. 4,248,160, a hatch cover and strap assembly is disclosed in which the strap and hatch cover are both pivotably mounted about a common pivot axis on a railway car roof. The strap engages the cover at the mid-portion of the cover and at the distal end of the strap, on the lower surface of the cover. An overcenter latch assembly is pivotably mounted upon the car roof at a location opposite the common hatch cover and strap pivot axis. This latch assembly includes a bifurcated overcenter locking handle which has a pair of cam surfaces which in closed position engage spaced wear plate surfaces located on the strap.

An operating handle for the latch assembly in closed position extends from the cam surfaces toward the strap and hatch cover pivot axis.

However, when the car is under pressure above atmospheric, it has been found that when the operating handle is manually pivoted outwardly from the overcenter position toward open position, and out of engagement with the strap, the pressure in the car acting on the cover and the strap causes the cover and strap to fly up, creating a hazard for the attendant.

SUMMARY OF THE INVENTION

The object of the present invention is to provide an improved hatch cover latch assembly for use with the hatch cover and strap assembly described above, whereby when the car is pressurized, it will prevent the cover and strap from flying open when the cover is opened, and thus avoid a safety hazard to the attendant.

In accordance with the present invention at least one tab is located on the strap adjacent but outboard of the cam surface on the operating handle. The tab makes a sufficient angle with the horizontal and extends upwardly and outwardly from the cam surface a distance sufficient to prevent the cam portion of the operating handle from moving longitudinally and disengaging from the strap when the car is pressurized and the cover is opened, whereby the strap and cover fly open. Preferably, a pair of tabs are provided to engage each cam surface of the bifurcated operating handle.

For an operating handle having a pivot of approximately one (1) inch above the strap engaging surface or wear plate, and a radius of curvature outboard of the strap engaging surface of approximately three (3) inches, the tab is preferably located at least one half inch (0.5) inches outwardly from a vertical plane passing through the engagement point. The tabs preferably make an angle of at least 40° with the horizontal and extend at least about ⅜" in length. Angles in excess of about 60° tend to provide too steep an incline for the cam to pass over after the pressure has been released. In general, the greater the angle used, the shorter should be the upward and outward extent of the tabs.

Preferably the tabs are formed in wear plates which the cam surfaces engage in closed position.

In one embodiment the outer end portion of the tab is supported by a tab support extending vertically upwardly from the wear plate or strap surface located below the end of the tab. Preferably this tab support comprises a tab portion bent into a generally vertical direction and extending downwardly to engage the wear plate or strap to support the tab portion which the cam engages as the pressure is released and then rides over when the pressure is relieved.

IN THE DRAWINGS

FIG. 3 is a schematic perspective view of the handle and cover with the handle in open position.

Figure 1:
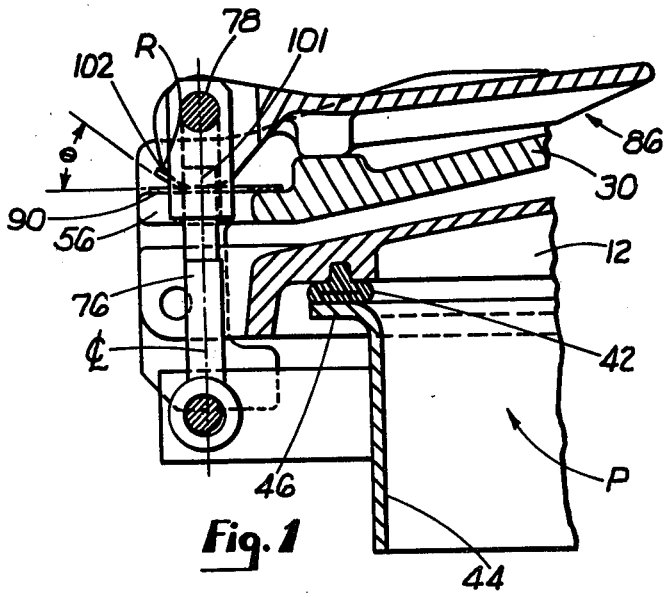
FIG. 1 is a vertical sectional view of the hatch cover and strap assembly according to the present invention with the handle in closed position.

FIG. 4 is a detail perspective view of the wear plate utilized in the construction shown in U.S. Pat. No. 4,248,160.

FIG. 5 is a detail perspective view illustrating one embodiment of the present invention.

FIG. 6 is a detail perspective view illustrating another embodiment of the present invention.

DESCRIPTION OF PREFERRED EMBODIMENTS

As is described in greater detail in U.S. Pat. No. 4,248,160, the entire disclosure of which is hereby incorporated into the present application by this reference, a hatch cover 12 and a hatch cover strap 30 are pivotably mounted upon a common axis on a railway car roof. The cover includes a seal 42 which engages a flange portion 46 of a coaming 44. The distal end 56 of the strap includes a surface 58 which supports a wear plate 90.

An operating handle 86 is bifurcated and includes a pair of cam surfaces 88. The handle is pivotably mounted about a pin 78. Handle 86 is part of a latch assembly 70 described in greater detail in U.S. Pat. No. 4,248,160. However, this latch assembly includes a vertically extending arm 76 which is pivotably mounted upon the car outboard of the coaming 44 by means of brackets 72, 73 and pin 74 (FIG. 3).

When a pressure P is present within the car, and the operator pivots the handle 86 in a counterclockwise direction about the pin 78, (FIG. 1), the pressure P within the car urges the cover 12 into engagement with the strap 30. The strap 30 is in turn urged into engagement with the wear plate 90 and the cam surface 88. When the handle 86 has moved past the location of the pin 76, the pin 76 can pivot in a counterclockwise direction out of engagement with the strap. The pressure then exits as indicated by arrow $A_1$ and also urges the cover 12 and the strap 30 rapidly upwardly with considerable force as indicated by arrow $A_2$, causing a danger to the attendant. The cover and/or strap may strike the attendant and/or scare the attendant.

In accordance with the present invention, tab means are provided indicated at 100 (FIG. 5) to prevent the handle from disengaging from the strap 30 or wear plate 90 until such time as the pressure P within the car has been dissipated. The tab means 100 includes at least one tab member 102 which is located adjacent to, but spaced from, the portion 101 of the cam 88 which engages the wear plate 90, or in the alternative, the strap 30. The tab 102 makes a sufficient angle $\theta$ (FIG. 1) with the horizontal, and extends upwardly and outwardly a distance sufficient to engage the front portion of the cam and a distance sufficient to prevent the handle from moving beyond the tab until the pressure within the container is released. The pressure is released when the cover 12 and seal 42 move a small distance above the coaming flange 46 after the cam surface 101 has moved sufficiently to allow the cover to move up to allow exit of the gasses within the car as indicated by the arrow $A_1$.

The tab 102 makes an angle $\theta$ with the horizontal of at least about 40°. Angles less than 40° were tried and were unsuccessful in preventing exit of the handle until the pressure was released. Preferably, the angle $\theta$ is not more than about 60° because angles in excess of about 60° tend to make it difficult to move the cam over the tab after the pressure has been released.

Preferably, the length of the tab is such that when the cam surface engages the tab, the radius of curvature of the tab and the length of the tab are such that the cam surface is substantially tangent to the tab. For a radius of curvature (R), (FIG. 1), of approximately three (3) inches a tab length of ½" has been found to be satisfactory.

The tab is to be spaced laterally a suitable distance from the center (CL) of the cam portion 101. In experiments concerning the present invention, it was found that if the tab is located such that it engages the cam, that it was not successful in preventing the cam from exiting until the pressure was released. For a cam having a radius of curvature (R) of approximately three (3) inches and a distance of the pin 78 above the strap 30 of approximately one (1) inch, a lateral distance of at least about one-half (½) inch has been found to be satisfactory.

As shown in FIG. 5, it is preferred to provide a pair of tabs 102 and 104 on either side of the pin 76 to engage each of the cam surfaces 88.

The tabs 102 and 104 are most conveniently provided by modification of the flat "U" shaped wear plate 90. A thickness of about 0.125 inches is conveniently used. Slots 106 and 108 are cut into the plate a suitable distance. For the dimensions given above, a slot extending ½" inwardly from the outboard end of the wear plate is satisfactory. The tabs 102 and 104 are then formed by bending the inner portions upwardly according to the pregoing description.

Fastener openings 108 are provided to receive fasteners 109 (FIG. 3) and attach the wear plate to the strap with fasteners 109 in the manner illustrated in U.S. Pat. No. 4,248,160 patent.

Another embodiment of the invention is illustrated in FIG. 6. In this embodiment the tab means 110 includes at least one and preferably a pair of tabs 112 and 114 provided respectively with tab supports 116 and 118. These tab supports 116 and 118 are most conveniently formed by utilizing an extended tab portion 112 and 114, and bending the outer ends down to form a pair of generally vertically extending supports 116 and 118. However, it will be apparent to those skilled in the art that the support members 116 and 118 could be separate members welded or otherwise connected to wear plate 90 and/or strap 30.

It will be apparent that the tabs 102, 104 and/or 112, 114 are most conveniently formed in wear plate 90 and 110. However, it is within the scope of the present invention to form the tabs integral with the strap 30. For example, the tabs could be welded directly to the strap 30 or the strap 30 could be cast with the tabs an integral part of the casting.

Figure 2:
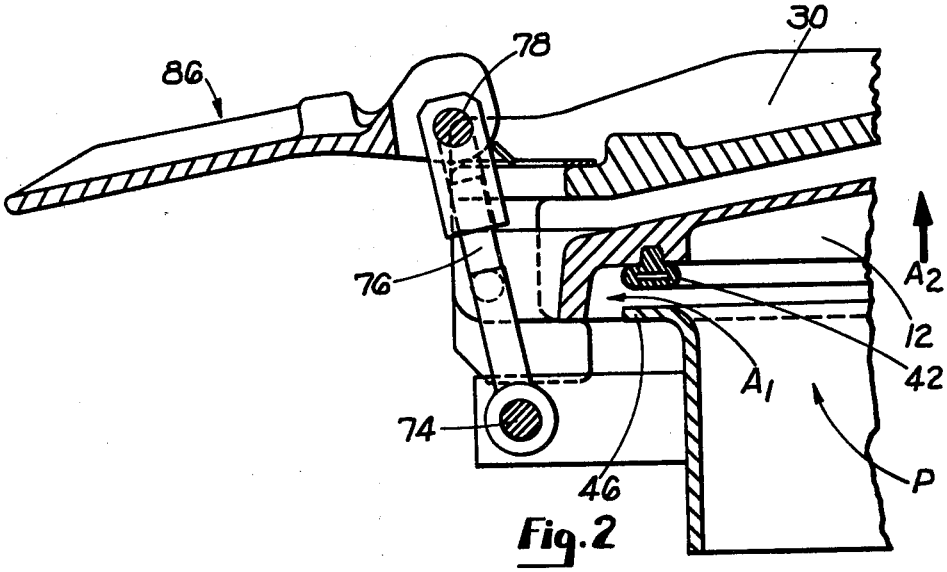
FIG. 2 is a view similar to FIG. 1 with the handle in open position.

In the operation of the present invention, assuming that the cover 12 is to be opened while a pressure P is present within the car, the attendant grasps the handle 86 and pivots the handle counterclockwise. This action moves the surface 101 out of engagement with the wear plate 90, and allows the cover 12 to move upwardly a small distance above the coaming 46. When this occurs, the pressure P can be dissipated relatively quickly by gasses passing out between the coaming 44 and the seal 42 as indicated by the arrow $A_1$ in FIG. 2. However, during this period, the pressure P acts upon the cover 12 and the strap 30. This in turn urges the handle cam portion 88 into engagement with the tabs 102, 104 or 112, 114. The tabs 102, 104 or 112, 114 prevent the cam surface 101 from becoming disengaged with the strap 30 and thus allowing the strap and cover 12 to fly upwardly to injure and/or scare the attendant.

After the pressure has been dissipated, the cover 12 and the strap 30 drop by gravity and assume a seated position, as shown in FIG. 1. It then is a simple matter to move the handle laterally with the cam surface 88 moving over tabs 102, 104 or 112, 114. The handle 86 may then be used to pivot the arm 76 about its pivot point and locate the handle and pin on the car roof (FIG. 3). The cover is then obstructed and may then be moved to open position by an operating handle (not shown). The car may then be loaded or unloaded as the case may be.

FIG. 3 shows the simple step of removing a prior wear plate 90 (FIG. 4) without the tab means and inserting instead a wear plate including tab means 100 or 110. FIG. 3 also shows projections 14 extending from the cover 12 having openings 16 adapted to receive a car seal (not shown).

It will be apparent from the foregoing that the provision of the tab means 100 and 110 results in a much safer strap and hatch cover assembly than illustrated in U.S. Pat. No. 4,248,160.

What is claimed is:

1. In a hatch cover and strap assembly including a strap and hatch cover pivotably mounted upon a railway car roof in which the strap engages the cover at least at the midportion of the cover and at the distal end of the strap, an overcenter latch assembly pivotably mounted upon the car roof at a location opposite the strap pivot axis; said hatch assembly including an overcenter locking member which has at least one cam surface which in closed position engages a wear surface located on the strap, the improvement comprising: tab means formed in a removable wear plate located on said strap and preventing said handle from disengaging from said strap until pressure within said car has been relieved; wherein said tab means comprises at least one tab located adjacent, but outboard of, the cam surface on the operating handle; said tab making a sufficient angle with the horizontal and extending upwardly and outwardly from the cam surface a distance sufficient to prevent the cam portion of the operating handle from moving longitudinally and disengaging from the strap until pressure within the car is dissipated, whereby the strap and cover are prevented from flying open; the outer end portion of said tab means being supported by a tab support extending vertically upwardly from a support surface below the end of the tab.

2. A hatch cover and strap assembly according to claim 1, wherein said tab means comprises a pair of tabs provided to engage a cam surface on each arm of an operating handle.

3. A hatch cover and strap assembly according to claim 1, wherein said tab support comprises a tab portion bent into a generally vertical direction to support the tab portion which the cam engages as the pressure is released.

4. In a hatch cover and strap assembly comprising: a strap and hatch cover pivotably mounted upon a railway car roof upon a cover pivot axis; said strap engaging the cover at the distal end of the strap; an overcenter latch assembly pivotably mounted upon the car roof at a location opposite the strap pivot axis; said latch assembly including an overcenter locking member which has at least one cam surface which in closed position engages a wear surface located on the strap; and tab means formed in a removable wear plate located on said strap and preventing said handle from disengaging from said strap until pressure within said car has been relieved; said tab means comprising at least one tab located adjacent, but outboard of, the cam surface on the operating handle; said tab making a sufficient angle with the horizontal and extending upwardly and outwardly from the cam surface a distance sufficient to prevent the cam portion of the operating handle from moving longitudinally, and disengaging from the strap until pressure within the car is dissipated, whereby the strap and cover are prevented from flying open; the outer end portion of said tab means being supported by a tab support extending vertically upwardly from a support surface below the end of the tab.

5. A hatch cover and strap assembly according to claim 4, wherein said tab means comprises a pair of tabs provided to engage a cam surface on each arm of the operating handle.

6. A hatch cover and strap assembly according to claim 4, wherein said tab support comprises a tab portion bent into a generally vertical direction to support the tab portion which the cam engages as the pressure is released.

* * * * *